United States Patent [19]

Haseley et al.

[11] Patent Number: 4,969,801

[45] Date of Patent: Nov. 13, 1990

[54] METHOD AND APPARATUS FOR SHUTTING OFF A COMPRESSOR WHEN IT ROTATES IN REVERSE DIRECTION

[75] Inventors: Robert K. Haseley, Mooresville; Paul A. Kirkpatrick, Charlotte; Jimmy L. Levan, Statesville, all of N.C.

[73] Assignee: Ingersoll-Rand Company, Woodcliff Lake, N.J.

[21] Appl. No.: 432,017

[22] Filed: Nov. 6, 1989

[51] Int. Cl.[5] ..... F04B 49/02

[52] U.S. Cl. ..... 417/18; 417/28; 417/32; 417/33; 417/44; 417/53

[58] Field of Search ..... 417/1, 18, 26, 28, 32, 417/33, 44, 45, 53, 295

[56] References Cited

U.S. PATENT DOCUMENTS

| | | | |
|---|---|---|---|
| 4,149,827 | 4/1979 | Hofmann, Jr. | 417/53 |
| 4,227,862 | 10/1980 | Andrew et al. | 417/18 |
| 4,336,569 | 6/1982 | Tsuda et al. | 361/395 |
| 4,646,528 | 3/1987 | Marcade et al. | 62/127 |
| 4,652,976 | 3/1987 | Fushimoto | 361/413 |
| 4,762,469 | 8/1988 | Fischer | 417/279 |
| 4,788,447 | 11/1988 | Kiyono et al. | 307/10 R |
| 4,791,258 | 12/1988 | Youtz et al. | 200/302.1 |

*Primary Examiner*—Leonard E. Smith
*Assistant Examiner*—David W. Scheuermann
*Attorney, Agent, or Firm*—Glenn B. Foster

[57] ABSTRACT

A fluid compression system includes a fluid compression device which pressurizes fluid. A pressure sensor senses pressure generated by the compression device. A control device indicates operating parameters and functions of the compression device, graphically displays the parameters and functions, sets limits of the parameters and controls the compression device in response to any of the parameters reaching a preset level of a corresponding function. A reverse rotation sensor determines when the compression device is operating in an incorrect direction by the initial pressure sensed by the pressure sensor after startup of the compression device, and in response, shuts off the compression device.

30 Claims, 3 Drawing Sheets

METHOD AND APPARATUS FOR SHUTTING OFF A COMPRESSOR WHEN IT ROTATES IN REVERSE DIRECTION

BACKGROUND OF THE INVENTION

This invention relates generally to electronic controls, and more particularly to an electronic control system which is capable of sensing reverse rotation of a fluid compression means such as a compressor or pump.

Previously, fluid compression means have been controlled by electromechanical means. Even though these control means could display the pressure and temperature of the fluid compression means, they could not respond with reliable accuracy or display the pressure or temperature prior to an undesired shutdown of the compressor or pump.

In particular, air compressors, have been limited from running in the incorrect direction by the operators being instructed to determine the original pressures being produced by the compressor. If the original pressures were negative, then the operator should have shut off the machine because it was operating in reverse rotation mode. However, inattentiveness and unawareness of the operators frequently lead to continued operation in the reverse rotation mode, and subsequent damage to the compressor The foregoing illustrates limitations known to exist in present devices and methods. Thus, it is apparent that it would be advantageous to provide an alternative directed to overcoming the limitations set forth above. Accordingly, a suitable alternative is provided including features more fully disclosed hereinafter.

SUMMARY OF THE INVENTION

In one aspect of the present invention, this is accomplished by providing an apparatus for controlling a fluid compression system including a compression means for pressurizing fluid. Pressure sensor means sense pressure generated by the compression means. Reverse rotation sensor means determines when the compression means is operating in an incorrect direction by negative pressure sensed by the pressure sensor means, and in response shuts off the compression means.

The forgoing and other aspects will become apparent from the following detailed description of the invention when considered in conjunction with the accompanying drawing. It is to be expressly understood, however, that the drawing figures are not intended as a definition of the invention, but are for the purpose of illustration only.

DETAILED DESCRIPTION

Figure 1:
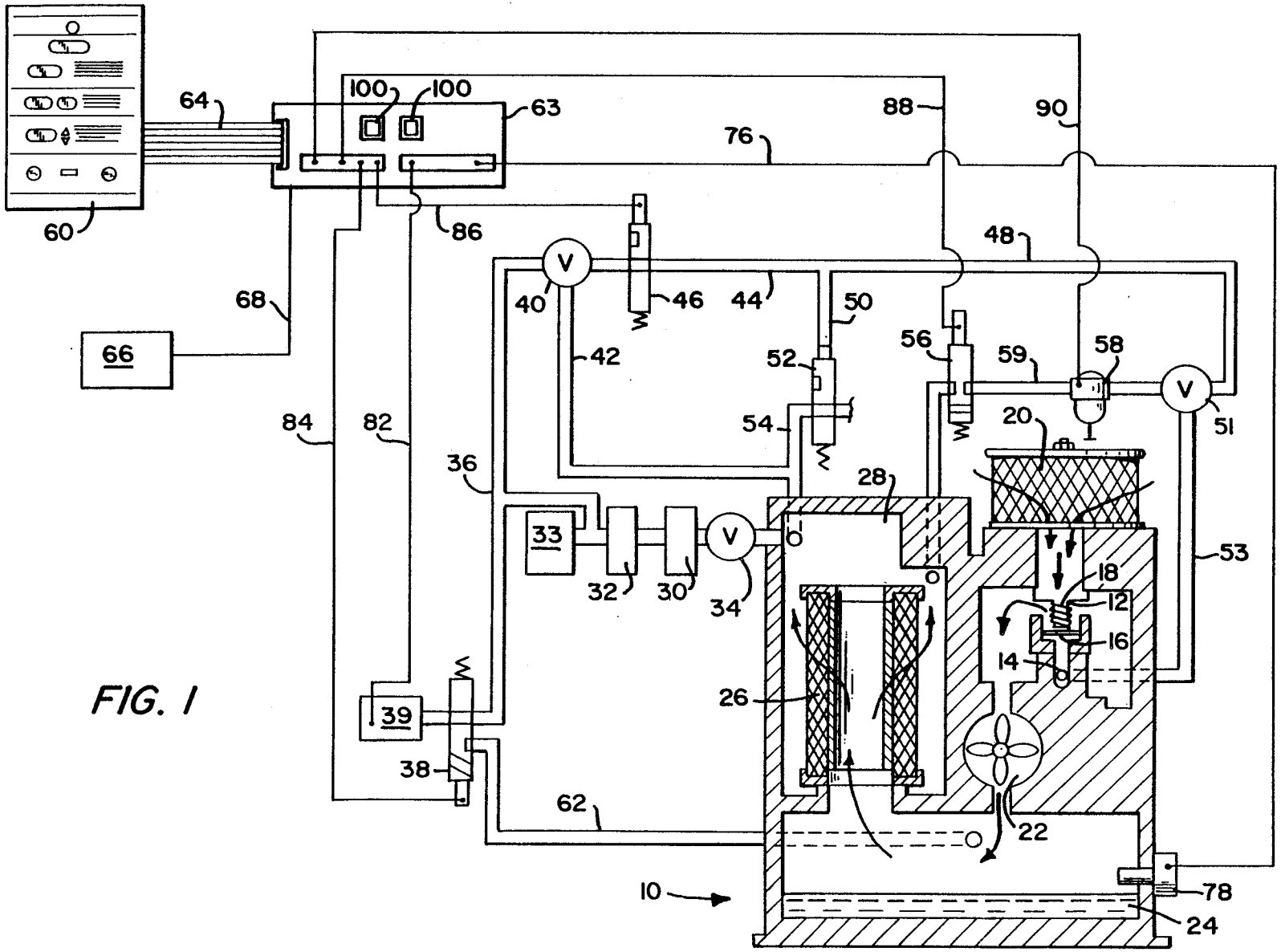
FIG. 1 is a schematic view illustrating an embodiment of a compressor, with the associated tubing and electrical wiring utilized to operate the compressor, including valves displayed as they would appear in an unloaded state.
Figure 2:
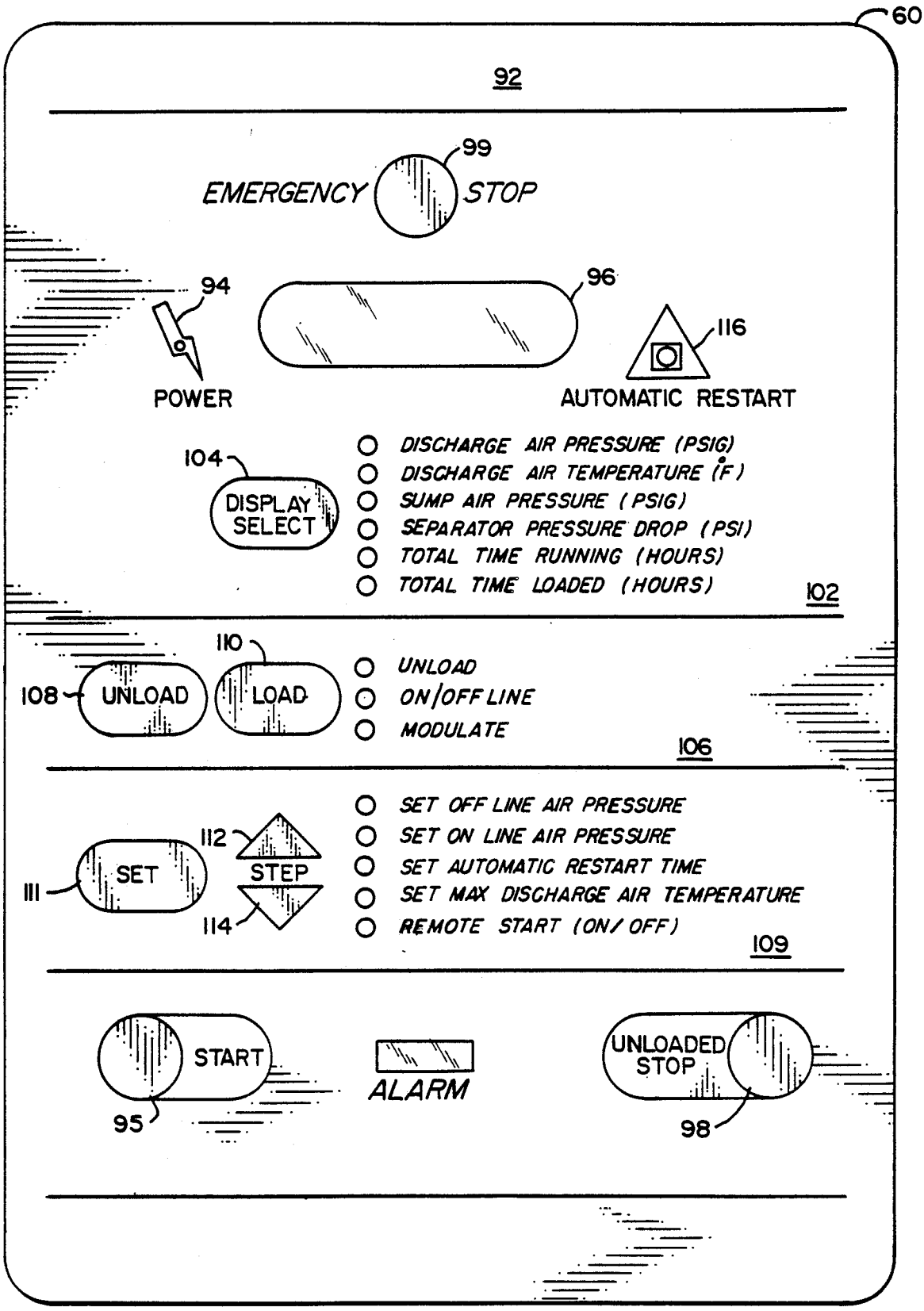
FIG. 2 is a front view illustrating an embodiment of the controller panel of the instant invention including various controller parameters and controller functions.
Figure 3:
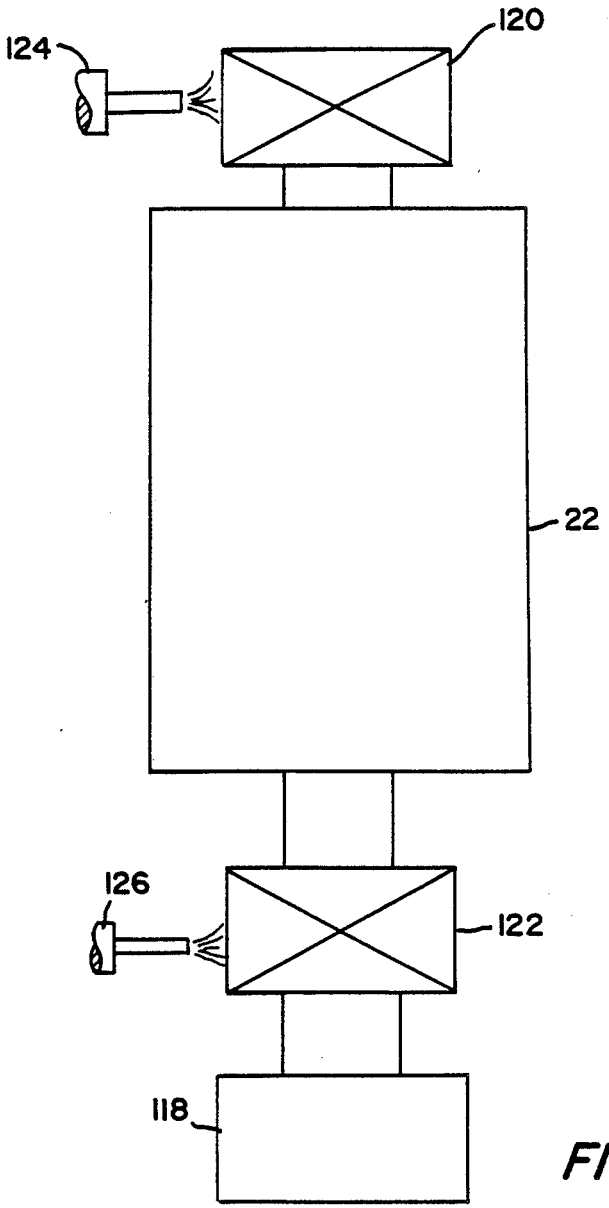
FIG. 3 is a schematic diagram illustrating an embodiment the compressor rotor, bearings and the associated cooling elements.

Referring now to the drawings, FIGS. 1,2, and 3 illustrate an embodiment of the control system for an air compression system of the instant invention. It is to be understood that while this disclosure is being described as applied to an air compressor, it could similarly be applied to any compressor, pump or device which produces pressures. Similar elements are identically numbered throughout the Figures.

Piping System

A compressor controlled by a controller 60 of the instant invention is shown generally at 10. An inlet valve 12 is closed whenever the pressure in an inlet port 14 exerts a pressure on piston 16 which overcomes spring 18. All the air entering the inlet valve has passed through air filter 20. The air which has passed through the inlet valve is propelled by the compressor rotor 22 into compressor sump 24.

The compressor rotor 22 may be rotary, axial, or any other well known type. Oil is used both to cool and lubricate the rotor 22, and is collected in the sump 24. A separator filter 26 removes the oil from the air which has passed through the rotor 22 into the sump 24. Air which has passed through the filter 26 enters a compressor discharge or outlet 28. The discharge 28 is connected via a minimum pressure check valve 34, an aftercooler 30 and a moisture separator 32 to a user of the compressed air 33. The minimum pressure check valve 34 maintains the pressure in the compressor at a certain pressure (for example 30 psi).

The piping system relates to the compressor as follows. The pressure line 36 is connected to, and contains the same pressure as the compressor discharge 28. Pressure line 36 connects a line/sump solenoid valve 38 to a shuttle valve 40. Line 42 connects the compressor discharge 28 to the shuttle valve 40. A line 44, which incorporates unload solenoid valve 46, branches into a blowdown line 50 and a line 48. Blowdown line 50, when pressurized, opens a blowdown valve 52 and permits the pressure contained within the compressor discharge 28 to escape via a vent line 54 to the atmosphere.

The vent line 54 may optionally be connected through the air filter 20 to limit the noise of air escaping from the discharge 28. If the vent line is connected to the filter, however, then a blowdown orifice, not shown, should be included to limit the reverse passage of oil which would otherwise travel from the inlet area to the discharge.

The line 48 connects via shuttle valve 51 to input valve line 53. A modulating line 59, incorporating a modulating solenoid valve 56 and a modulating adjusting valve 58, connects the compressor discharge 28 to the shuttle valve 51. Whichever line 48 or 59 has the greatest pressure will be connected to the input valve line 53.

A pressure sensor or transducer 39 monitors the pressures of line 36 and sump line 62, as controlled by the line/sump solenoid valve 38. The controller switches the position of the solenoid valve 38 several times a second such that both the individual line pressures, and the difference between the two pressures, can be accurately determined. The operation of the controller 60 with respect to the line/sump solenoid valves will be described later in this specification.

Piping Operation

The compressor 10 and the associated components of the instant invention may be operated in three modes: unloaded, on line/off line, and modulate. The unloaded mode is most efficient during the start up of the compressor and when it is desired to limit the output air of the compressor since there will be no fluid compressed by the compressor. The on line/off line mode is most efficient when the compressor is experiencing a widely varying fluid demand (as occurs when the user is using an air tool intermittently) since this will minimize the amount of time that the compressor is actually operating to maintain a constant pressure. The modulate mode is most efficient when used in those instances where the compressed fluid demand relative to the compressor capacity is relatively high since the amount of fluid pumped per unit time by the compressor will be regulated depending upon the need of the compressor. The compressor will therefor not be operating at the full energy consumption, or repetitively starting and stopping, unless it is required.

In the unloaded mode, the compressor will not be displacing any air since the inlet valve 12 will be closed. The controller 60 will open the unload solenoid valve 46, causing the discharge pressure in pressure line 36 to be applied through line 44 to the line 48 and the blowdown line 50. The pressure in blowdown line 50 will open blowdown valve 52, venting the pressure in the discharge 28 via vent line 54 to the atmosphere. Concurrently, the pressure in line 48 will pass through valve 51 and line 53 to inlet port 14, causing the inlet valve 12 to be closed.

In the on line/off line mode the unload valve 46 will be closed, causing the inlet valve to open permitting the compressor to displace air, and causing the blowdown valve 52 to close preventing the venting of the compressor discharge 28 to the atmosphere. However the compressor itself may be shut down to prevent the passage of air through the compressor during the off line mode.

In the modulate mode, the controller will still deactivate the unload valve as described in the prior paragraph, but the modulating solenoid valve 56 will be open. The pressure in compressor discharge 28 will be applied through the modular line 59, the valve 56, and the modular adjustment valve 58 (where the operator may adjust the pressure via the controller). The discharge pressure will be adjusted by the modular adjustment valve 51 and applied to input line 53 and the inlet port 14 via valve 51. The pressure at which the inlet valve will open will be controlled by the controller.

Electrical System

The controller 60 indicates which functions and parameters of compressor 10, such as temperature and pressure, the operator may select to be displayed, quantitatively displays those functions and parameters, sets the limits of the parameters, and controls the compressor 10 if the parameters exceed the limits. The following elements are used in the operation of the controller 60.

The controller 60 transmits all of the information to a printed circuit board 63 via conductor cable 64. Power is applied to the controller 60 from a voltage source 66 via a conductor 68 and conductor cable 64.

There are several inputs to the printed circuit board 63. Conductor 76 connects a thermistor 78 to the board 63. thermistor 78 is connected to the sump 24. This thermistor detects the discharge temperature since the temperature at the sump equals the temperature at the discharge 28.

A conductor 82 connects the printed circuit board to the pressure sensor 39, and senses the pressures of both the compressor sump 24 and the compressor discharge 28. The controller monitors temperature and pressures at both locations several times a second, to ensure that none of the functions exceed a preset limit (either set by the operator or the manufacturer).

There are also several outputs from the controller 60, through conductor cable 64 and the printed circuit board 63 which control the operation of the compressor 10. A conductor 84 connects the board 63 to the solenoid valve to control whether the pressure sensor will read the sump 24 pressure or the discharge 28 pressure.

A conductor 86 connects the board to the unload solenoid valve 46 to control when the valve 46 will open and cause the compressor to enter an unloaded state. When the unloaded valve opens, the blowdown valve 52 will open, venting the pressure in the compressor discharge 28 and line 42 to the atmosphere.

A conductor 88 connects the board 63 to the modulating solenoid valve 56. When the controller 60 activates valve 56, the compressor will go into the modulating mode, the inlet valve 12 will be controlled by the modular adjustment valve 58. Valve 58 connects to board 63 via conductor 90. In this manner, the controller not only determines the operating conditions of the compressor, but also controls the operation of the compressor.

Controller Operation

A faceplate 92 of the controller 60 is shown in FIG. 2. A power indicator to the controller is shown as 94, and the compressor may be powered by pressing a start switch 95. The controller may be placed in the unloaded condition and then stopped by pressing an unloaded stop switch 98. If there is some reason why the compressor must be stopped instantly, then an emergency stop switch 99 may be pressed.

A graphic display 96, such as an LED, is used to display the controller parameters. The parameters are considered as those characteristics which are not controllable by the controller during the operation of the compressor. Any analog or digital display which is presently known to graphically display parameters or functions may be utilized in this application. The parameters 102 shown on the controller of FIG. 2 include operating outlet and sump pressures, difference between the inlet and the sump pressures, total time which the compressor has been running, total time in which the compressor has been running in an unloaded state, and the compressor discharge temperature.

The graphic display 96 is also used to display the maximum set point of all functions 109. The functions are performed by the controller 60 during the operation of the compressor, and include the set on and off line air pressures, the automatic restart time, the maximum discharge air temperature, and the remote start. The operation of these functions will be described latter in the specification.

The graphic display 96 can also display codes or phrases to describe why the controller shut itself off. For example if the controller shut itself off for excessive sump pressure, the controller will remain in a locked position until the pressure returns to an adequate level, and the code or phrase which describes excessive sump pressure will be displayed on the graphic display.

The controller has the capabilities to have a memory and an associated printout. In those instances where the compressor 10 shuts itself off since one of the functions was exceeded but the user is unsure which function it was, the user can analyze the printout to determine which function was exceeded.

The controller 60 also has a timing capability integral with the printed circuit board 63. Therefore, the controller has the ability to determine how long the compressor has been operating in total and how long the compressor has been operating in an unloaded state.

The controller 60 also has a modular section 106, by which the mode in which the controller is operating in can be controlled. Due to the timing circuit, the controller 60 has the capability of determining which is the best mode of operation for the compressor to be operating under considering the present state of operation. If the controller is in the on line/off line mode, and the compressor switches between the on and off line positions an established number of times within a specified period (for example three times within three minutes), then the controller will default the compressor to the modulate mode, which would be more suitable considering the operation of the compressor.

The controller has an unloaded stop switch 98 to place itself in an unloaded condition prior to the time that the compressor fully stops. It is greatly preferred that a compressor be stopped in the unloaded state since if the compressor stops with any pressure in the sump 24, damage could result to the rotors 22 by the pressure in the sump 24 attempting to escape through the rotors. The unloaded stop switch 98 operates by turning the compressor to the unloaded state a short period (for example seven seconds), before the compressor is turned off.

If there is some reason why the operator wishes to instantly turn the compressor off, then there is an emergency off switch 99 which turns the machine off in its loaded state.

A single pressure transducer 39 is used to measure more than one pressure since the line/sump solenoid valve switches the pressure which is applied to the transducer input between pressure lines 36 and 62. Previously, two pressure sensors were required to read the pressures. This multiplicity of pressure sensors not only lead to increased expense, but also to inconsistent readings.

The controller 60 also has the capability of calibrating the pressure in the transducer 39 to a known pressure setting. If the transducer is reading a known pressure setting and indicating an incorrect reading, then the controller pressure display can be raised or lowered that amount. This not only is helpful to adjust an inaccurate transducer, but also to calibrate the setting when the compressor is brought to a location with a different pressure (due to high altitude, etc.).

Controller Interface

The operator of the controller may interface with the controller by pressing various buttons or switches. The parameters are shown in a parameter section 102. A parameter display tactile membrane button 104 is pressed to select the specific parameter which is to be displayed.

The mode which the compressor is operating under is controlled by a modular control section 106 of the controller. An unload tactile button 108 is pressed to place the compressor in an unload mode. Depending on the number of times which a load switch 110 is pressed, the compressor is either placed in a specific mode of operation or the controller selects the most efficient mode of operation depending upon the operation of the compressor.

The setting of the functions controlled by the controller is regulated within a function section 109. The function which is desired to set can be selected by pressing the function set key 111. Once the desired function is set, the function set point may be altered by pressing function step buttons 112 and 114.

The compressor is programmed to turn itself off after a specific period after the operator has not used the compressor. At this time, an automatic restart indicator 116 will be on. When there is a call for air when the indicator is on, the controller will automatically restart the compressor.

REVERSE ROTATION

Reverse rotation occurs when the compressor rotors 22 are operating in the opposite direction from which they should normally operate. Reverse rotation is caused by incorrect electrical wiring alignment to a motor 118 which drives the compressor rotors 22.

Damage can result to the compressor as a result of reverse rotation. During normal operation, compressor bearings 120 and 122 are being sprayed by jets 124 and 126. The fluid which is being sprayed lubricates and cools the bearings 120, 122. Fluid, such as oil, which is used to spray the bearings 120, 122 is stored in the sump 24, and is forced through the jets 124, 126 by the sump pressure. When the compressor is operating in reverse, no pressure is generated in the sump, and therefore no cooling and lubricating fluid is sprayed over the bearings 120, 122.

To sense the reverse rotation of rotors 22, immediately after the startup of the compressor, the valve 38 is positioned so the sump line 62 pressure is read by the pressure transducer 39. An initial positive sump pressure indicates that the compressor is operating in the correct direction, and the compressor will be permitted to start up.

If on the other hand, the sump 24 pressure upon initial startup (sensed by controller 60) is negative, the rotor 22 will be assumed to be operating in the incorrect direction, and the controller will instantly shut down the compressor.

After the machine shuts down for reverse rotation, the code for reverse rotation will be displayed on the graphic display 96. The operator of the controller 60 will not be able to start the compressor until such time as the electrical wiring to the rotor motor 118 is placed in correct alignment While this invention has been illustrated and described in accordance with a preferred embodiment, it is recognized that variations and changes may be made therein without departing from the invention as set forth in the claims.

What is claimed is:

1. Apparatus for controlling a fluid compression system, comprising:

compression means for pressurizing fluid;

pressure sensor means for sensing pressure generated by said compression means; and reverse rotation sensor means for determining when the compression means is operating in an incorrect direction by negative pressure sensed by the pressure sensor means, and in response shutting off said compression means.

2. An apparatus as described in claim 1, further comprising:

control means for indicating operating parameters and functions of the compression means, graphically displaying the parameters and functions, setting limits of the parameters and controlling the compression means in response to any of the parameters reaching a present level of a corresponding function.

3. The apparatus as described in claim 2, wherein the compression means includes an inlet, an outlet and a sump.

4. The apparatus as defined in claim 3, wherein one of said functions is compression means outlet pressure.

5. The apparatus as defined in claim 3, wherein one of said functions is compression means discharge temperature.

6. The apparatus as defined in claim 3, wherein one of said functions is compression means sump pressure.

7. The apparatus as defined in claim 3, wherein one of said functions is compression means discharge pressure and one of the functions is compression means sump pressure.

8. The apparatus as defined in claim 7, wherein one of said functions is an indicated difference between the compression means sump and discharge pressures.

9. The apparatus as defined in claim 8, further comprising:

valve means switching a pressure applied to the pressure sensor means from the compression means outlet to the compression means sump.

10. The apparatus as defined in claim 3, wherein one of the parameters is maximum compression means discharge temperature.

11. The apparatus as defined in claim 3, wherein one of the parameters is off line pressure.

12. The apparatus as defined in claim 3, wherein one of the parameters in on line pressure.

13. The apparatus as defined in claim 3, wherein one of the parameters is automatic restart time.

14. The apparatus as defined in claim 7, wherein one of the parameters is an indicated difference between the compressor sump and the compressor discharge pressures.

15. The apparatus as defined in claim 3, further comprising;

an unloaded stop switch.

16. The apparatus as defined in claim 3, wherein the control means includes display select means having a tactile membrane.

17. The apparatus as defined in claim 9, wherein the compression means operates in a mode wherein, after a range is set for compression means outlet pressure, defined by upper and lower outlet pressure limits, the control means alters the operation of the compression means to return the pressure to within the range when the pressure exceeds either of the upper and lower limits.

18. The apparatus as defined in claim 3, wherein the compression means operates in a mode wherein after a range is set for outlet pressure, defined by upper and lower outlet pressure limits, the control means regulates airflow to the sump, while the compression means maintains constant rpm, to regulate the outlet pressure.

19. The apparatus as defined in claim 3, wherein the compression means operates in a first mode wherein, after a range is set for outlet pressure, defined by upper and lower outlet pressure limits, the control means will alter operation of the compression means, causing the outlet pressure to return within the range when the pressure exceeds either of the limits; the compression means operates in a second mode wherein, after the outlet pressure exceeds either of the limits, the control means will regulate airflow to the compressor sump while the compression means maintains constant rpm, to regulate the outlet pressure; and the control means determines which of the first and second modes is more efficient, depending upon the parameters determined by the control means compression means, and causes the compression means to operate in that mode.

20. The apparatus as defined in claim 19, wherein when the control means is operating in the first mode of operation, and the outlet pressure reaches the upper limit, the control means switches the compression means from an on line to an off line state.

21. The apparatus as defined in claim 19, wherein when the control means is operating in the first mode of operation, and the outlet pressure reaches the lower limit, the control means switches the compression means from an off line to an on line state.

22. The apparatus as defined in claim 19, wherein when the compression means is in said first mode of operation, and the compression means cycles between an on line and an off line state an established number of cycles within a predetermined period, then the control means switches the compression means to the second mode of operation.

23. The apparatus as defined in claim 3, wherein said pressure sensor is a transducer.

24. The apparatus as defined in claim 23, wherein the control means may be calibrated to read a known pressure setting when that known pressure is applied to the transducer.

25. The apparatus as defined in claim 23, wherein the transducer is used to measure a plurality of pressures.

26. The apparatus as defined in claim 3, further comprising:

an unloaded stop switch means for permitting the compression means to return to an unloaded state prior to shutting the compression means off.

27. The apparatus as defined in claim 3, wherein the control means comprises a graphical display including an L.E.D.

28. The apparatus as defined in claim 3, wherein the pressure sensor means senses the pressure generated by said compression means immediately after initial startup.

29. The apparatus as defined in claim 1, wherein the pressure sensor means senses the pressure generated by said compression means immediately after initial startup 30. A method for sensing reverse rotation in a fluid compression system including the steps of:

pressurizing fluid in a reservoir with a compressor;

sensing the pressure in the reservoir with a pressure transducer;

determining reverse rotation of the compressor by negative pressure read by said pressure transducer; and shutting off the compressor in response to said reverse rotation.

* * * * *